US010590602B2

(12) United States Patent
Sorrentino

(10) Patent No.: US 10,590,602 B2
(45) Date of Patent: Mar. 17, 2020

(54) METHOD FOR ASSEMBLING AN IMPROVED YANKEE CYLINDER

(71) Applicant: A. CELLI PAPER S.P.A., Capannori (IT)

(72) Inventor: Salvatore Sorrentino, Pinerolo (IT)

(73) Assignee: A. CELLI PAPER S.P.A., Capannori (IT)

( * ) Notice: Subject to any disclaimer, the term of this patent is extended or adjusted under 35 U.S.C. 154(b) by 154 days.

(21) Appl. No.: 15/739,004

(22) PCT Filed: Jun. 6, 2016

(86) PCT No.: PCT/IB2016/053301
§ 371 (c)(1),
(2) Date: Dec. 21, 2017

(87) PCT Pub. No.: WO2016/207752
PCT Pub. Date: Dec. 29, 2016

(65) Prior Publication Data

US 2018/0179705 A1 Jun. 28, 2018

(30) Foreign Application Priority Data

Jun. 23, 2015 (IT) ..... 10201526725

(51) Int. Cl.
*D21F 5/02* (2006.01)
*D21F 5/18* (2006.01)

(52) U.S. Cl.
CPC ..... *D21F 5/021* (2013.01); *D21F 5/181* (2013.01)

(58) Field of Classification Search
CPC ..... D21F 5/021; D21F 5/181
See application file for complete search history.

(56) References Cited

U.S. PATENT DOCUMENTS 8,438,752 B2 * 5/2013 Mennucci ..... D21F 5/021 162/357
9,885,152 B2 * 2/2018 Schmid ..... D21F 5/021

* cited by examiner

*Primary Examiner* — John C Hong
(74) *Attorney, Agent, or Firm* — Stein IP, LLC

(57) ABSTRACT

A method for producing a Yankee dryer cylinder, or Yankee cylinder, comprises the steps of disposing of a first and of at least a second cylindrical portion of shell. These are made of steel, have the same diameter and are provided with a plurality of grooves at an internal surface. In particular, the portions of shell, at a respective end, are provided of respective flange portions. The method provides to coaxially position the portions of shell up to arrange respective coupling surfaces of the flange portions adjacent one to the other. Then the engagement of the portions of shell is provided by means of a plurality of clamping members, each of which arranged to clamp the adjacent flange portions. Then, it is provided the circumferential welding of the cylindrical portion of the shell that are opposite to the flange portions, and the removal of the clamping members and of the flange portions.

11 Claims, 14 Drawing Sheets

300
301
disposing of a first and a second portion of shell
302
coaxially positioning the first and the second portion of shell
clamping the flange portions of the first and the second portion of shell
303
304
circumferential welding of the first and the second portion of shell
removing the clamping members
305
removing the flange portions
306

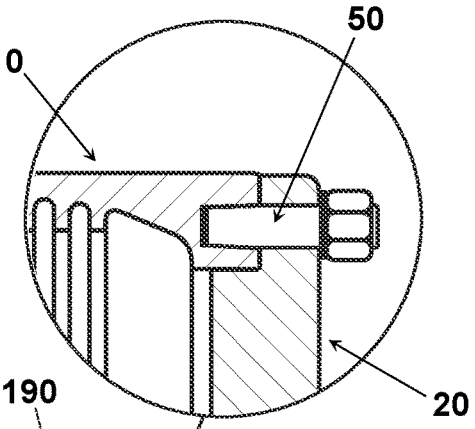
Fig. 7
Fig. 6
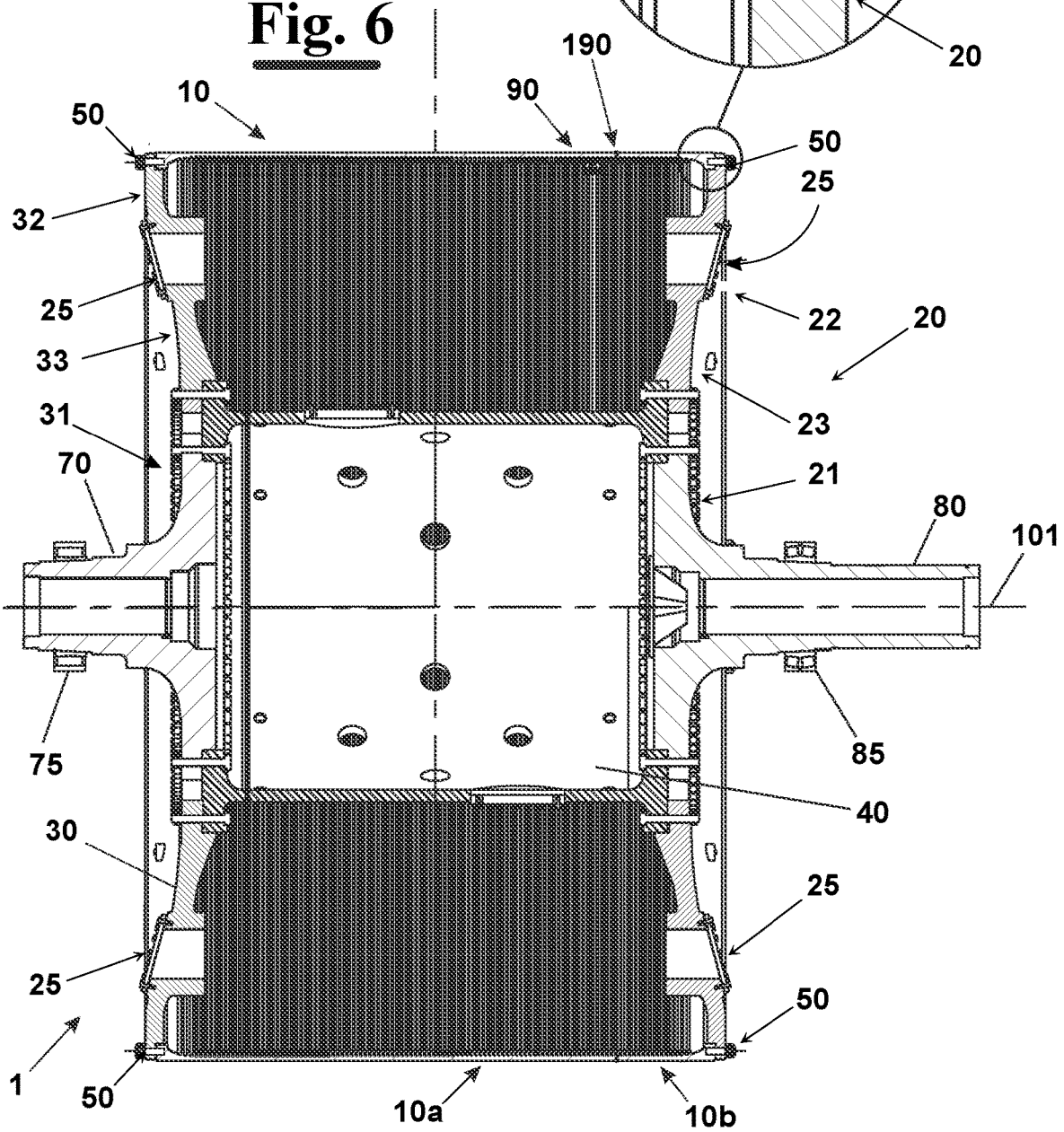

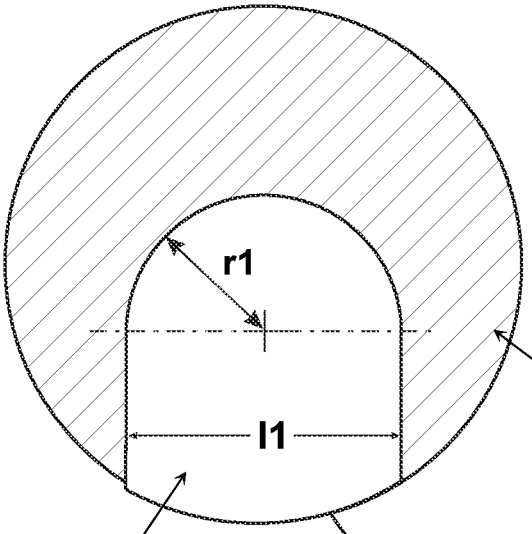
Fig. 19
Fig. 18
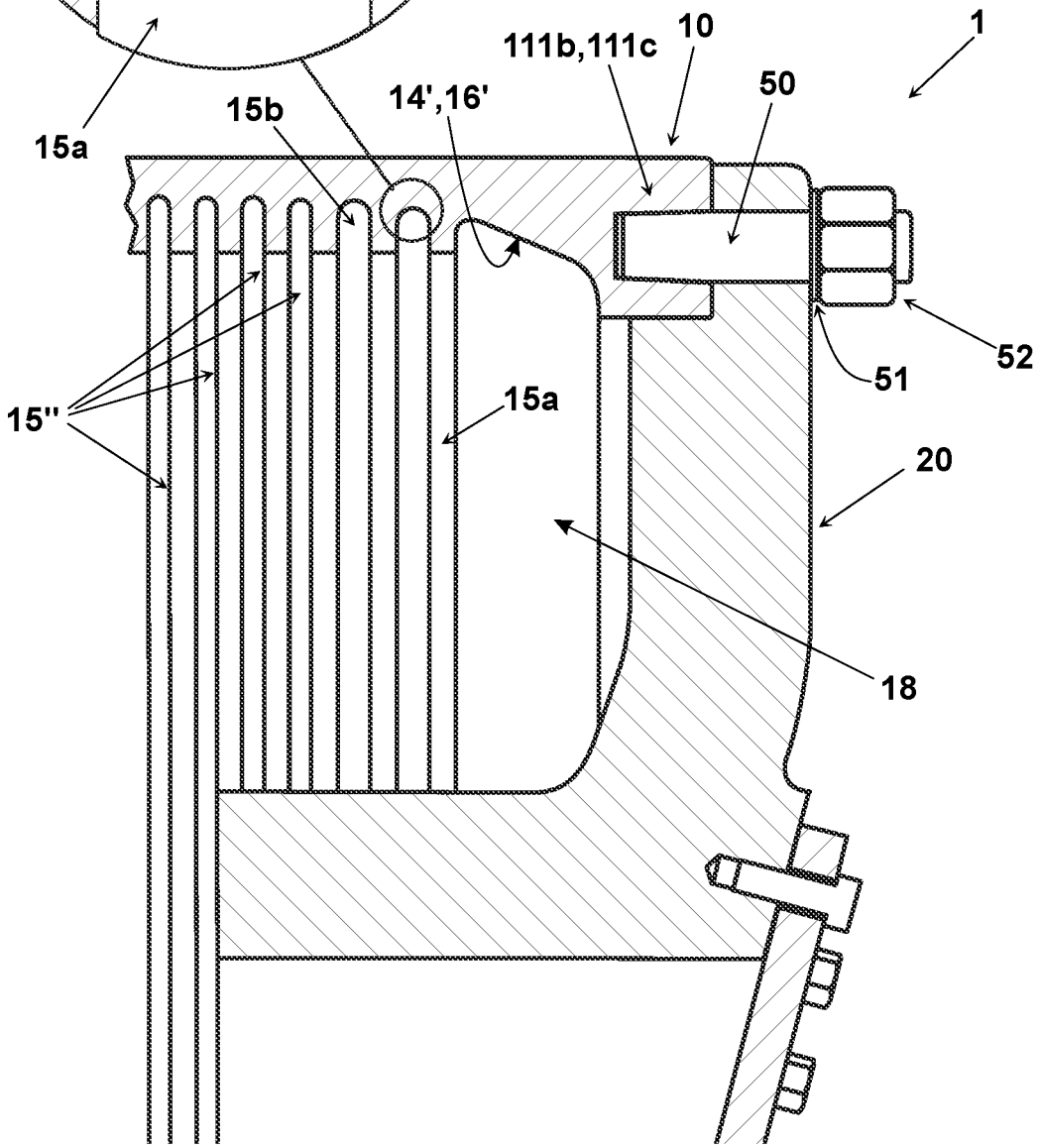

METHOD FOR ASSEMBLING AN IMPROVED YANKEE CYLINDER

CROSS-REFERENCE TO RELATED APPLICATIONS

This application is a national stage of International Application No. PCT/IB2016/053301 filed Jun. 6, 2016, which claims the benefit of Italian Application No. 102015000026725, filed Jun. 23, 2015, in the Italian Patent Office, the disclosure of which are incorporated herein in their entireties by reference.

FIELD OF THE INVENTION

The present invention relates to the field of machines for producing paper and similar products and, in particular, relates to a method for producing a dryer cylinder, also known as Yankee cylinder, of improved type, in particular a Yankee cylinder comprising a cylinder made of steel devoid of welds.

STATE OF THE ART

As known, the plants for producing paper provide the use of a headbox for distributing a mixture of cellulosic fibres and water on a forming fabric, and sometimes additives of different kinds. In this way, a determined amount of water is drained, thus increasing the dry content of the layer of the mixture that is present on the forming fabric.

The content of water is, then, reduced, through a sequence of steps among many fabrics and/or felts of the mixture layer, up to obtain a consistency that allows the passage through a drying section. This usually comprises at least a Yankee dryer cylinder, also called "Yankee cylinder" and a drying hood that is fed with hot air. In particular, the web of treated wet paper is laid on the external surface of the Yankee cylinder, whilst the inside of the Yankee dryer cylinder is heated, for example, by introducing steam. The steam produced inside the Yankee dryer cylinder and the hot air, which is blown by the drying hood on the paper, cause the web of wet paper, which is laid on the external surface, to gradually be dried. When the desired value of drying is achieved, the web of paper is removed from the external surface of the Yankee dryer cylinder by means of a blade, or doctor blade, or by tensioning, on the basis of the desired product, and in particular crepe paper, or smooth paper.

A Yankee dryer cylinder comprises essentially two heads, or end walls, between which a cylindrical shell is positioned. A bearing journal, which is mounted, in operating conditions, on a respective bearing, is fixed to each head. A hollow shaft is mounted inside the shell. The heads and/or the shell are provided with at least 2 inspection apertures through which at least a worker gets in the cylinder for periodically carrying out normal or extraordinary maintenance interventions.

The constituent elements of the Yankee cylinder, i.e. the heads, the shell, the bearing journals etc. can be obtained by melting of cast iron and can be fixed by means of bolts.

Alternatively, the Yankee cylinders can be made of steel. In this case the two heads can be fixed to the cylindrical shell by means of screw bolts, or more frequently by means of weld beads.

Both in the Yankee cylinders made of cast iron and in those made of steel, the cylindrical shell has an internal surface provided with circumferential grooves. These are arranged to collect the condensate that is formed for the transfer toward outside of the latent heat of vaporization from the steam that has been introduced inside the Yankee dryer cylinder.

Normally, the circumferential grooves have the same depth for all the length of the shell. See in this respect, for example, the document WO2008/105005.

In WO2014/077761 is, instead, disclosed a Yankee dryer cylinder made of steel and comprising a cylindrical shell to which 2 heads are fixed, at opposite sides, by means of respective weld beads. The cylindrical shell has an internal surface provided with circumferential grooves. Normally, the depth of the circumferential grooves gradually increases going from the most external grooves to the most internal grooves, i.e. the thickness of the cylindrical shell decreases. In the document it is explained that this kind of geometry allows to simplify the production of the Yankee cylinder.

This technical solution, is already largely used in the state of the art, and for example disclosed in the Italian patents IT276295 and IT277281 in the name of the same Applicant of the present application allows to make the cylinder highly resistant to stresses to which it is subjected in operating conditions, and at the same time to simplify the production with respect to other known solutions.

Nevertheless, all the Yankee cylinders of prior art, above disclosed, have many drawbacks.

Firstly, the Yankee cylinders of great size and weight are difficult to be transported to the destination plants. This problem is more felt if the destination plants, in particular the paper factory, are difficult to be reached because of insufficient, or non-existent, infrastructures as in the case of developing countries.

In particular, at the present time, an element that determines the superior limit of the size and weight of the Yankee cylinders is the insufficiency of the road, or the railway, network that is not able to ensure the safe transfer of the different components of the dryer cylinder, in particular the cylindrical shell, by means of traditional transports.

At the same time, in operating conditions, the Yankee cylinders have to be able to support high stresses, mainly thermoelastic stresses, due to the high temperature of the steam that is introduced, to pressure stresses, compressive forces and to the stresses due to the centrifugal force acting during the rotation of the cylinder about the rotation axis. Normally, the highest values both of the thermoelastic stresses and of the pressure stresses are recorded at the contact zones between the heads and the shell.

In fact, in operating conditions, the pressure deforms the shell and the heads in different way. Therefore, the contact zones between the shell and the heads are the most stressed zones.

In the Yankee cylinders of prior art, which are obtained welding the shell made of steel to the heads, these too, made of steel, the zones where the welds, which weaken the structure, are executed, are the most stressed zones of all the structure. Analogous drawbacks have been shown also if bolts are used to connect the heads to the shell. In fact, at the end of the Yankee cylinder assembly, not rarely, portions of screws protrude from the side of the shell at the contact zones between the shell and the heads. The protruding portions of screws, in operating conditions, cause the stresses to concentrate at the connection zones.

In the light of the above, the stresses to which the Yankee cylinder is subjected concentrate at the connection zones between the shell and the heads and therefore, in operating conditions, cracks and slits can happen that can cause, over time, the structure to be broken.

This determines the need to periodically carry out controls for verifying that structural failures are not present and however this causes a short service life of the Yankee cylinder.

Other examples of Yankee cylinders having analogous drawbacks are disclosed in EP2503055 and U.S. Pat. No. 3,116,985.

SUMMARY OF THE INVENTION

It is, therefore, an object of the present invention to provide a method for producing a Yankee cylinder that allows to overcome the above disclosed drawbacks, in particular that allows to transport easily the shells of Yankee cylinders of great dimensions and weight even in places difficult to reach because of a railway, or road, network that is not adequate.

It is also an object of the invention to provide such a method that allows, at same time, to ensure to distribute more uniformly the stresses, in particular the thermo-elastic stresses, the pressure stresses and the stresses produced by the centrifugal force, allowing to increase the performances and the service life of the Yankee cylinder.

This and other objects are achieved by a method for producing a Yankee dryer cylinder, or Yankee cylinder, comprising the steps of:

- disposing of a first and at least a second cylindrical portion of shell of said Yankee dryer cylinder, said first and second cylindrical portion of shell being made of steel and having the same diameter, said first and second cylindrical portion of shell having a respective internal surface provided with a plurality of circumferential grooves and a respective flange portion at a respective end;
- coaxially positioning said first and second cylindrical portion of shell up to arrange respective coupling surfaces of said flange portions adjacent one to the other;
- engaging said first and second cylindrical portion of shell by means of a plurality of clamping members, each clamping member of said plurality being arranged to clamp said adjacent flange portions;
- circumferential welding of said engaged first and second cylindrical portion of shell at the opposite side of said flange portions;
- removing said plurality of clamping members;
- removing the flange portions.

The solution provided by the present invention allows, in particular, to produce Yankee cylinders of great size and high weight for which it would not be possible to transfer a shell made in one piece. For example, in case of paper factories that are difficult to be reached due to inadequate infrastructures that means for the lack of road, or rail, network capable of ensuring to safely transfer the cylindrical shell.

In particular, the coupling surfaces of the flange portions of said first and second cylindrical portion of shell are configured in such a way to provide a fixed joint. In this way, during the successive production steps of the shell of the Yankee cylinder, the fixed joint ensures to maintain the correct relative positions between the different portions of the shell.

Preferably, before the step of coaxially positioning of said first and second cylindrical portion of shell, in particular before coupling them, a step is provided of making a circumferential housing between said coupling surfaces of said flange portions. In particular, the circumferential housing is arranged, in use, to house an annular body, preferably made of ceramic. This technical solution allows, in particular, to make, subsequently, a very narrow circumferential welding of the portions of the shell and, therefore, to avoid, shrinkage stresses.

In particular, an embodiment of the invention provides that the circumferential housing can be obtained by making a circumferential groove both at the first flange portion and at the second flange portion. In this case, the circumferential housing is obtained by positioning, in use, the circumferential grooves facing each other.

In particular, the annular body is removed, for example crushing it, once the flange portions have been removed.

In particular, the removing step of the flange portions can be carried out by means of a tool, for example a cutter. More in detail, a removal machine of the above disclosed flange portions is provided equipped with said tool. The machine can be provided, in particular, of an engagement portion al shell, for example at the internal surface of the shell, in particular at the grooves, and of a working portion provided with said tool.

The same tool can be also used for breaking the above disclosed annular body.

Preferably, once the removal of the flange portions has been carried out, a step is provided of making at least a circumferential groove between said coupled ends of said first and second cylindrical portion of shell. The above disclosed tool can be therefore also used for making the above disclosed groove.

Advantageously, both the first and the second cylindrical portion of shell are obtained through the steps of:

- disposing of a tubular semifinished product made of steel having a side wall provided with an internal surface and an external surface;
- forging said tubular semifinished product up to obtain a first predetermined thickness at a central portion of said side wall and greater predetermined thickness at enlarged terminal portions;
- making a plurality of circumferential grooves at said internal surface of said tubular semifinished product obtaining the first, or the second, cylindrical portion of shell.

In particular, the enlarged terminal portions can have substantially the same thickness greater than the thickness of the central portion, i.e. s2=s3. Alternatively, the enlarged terminal portions can have different thicknesses.

Preferably, at the external surface of the enlarged portion of said opposite cylindrical portion of the shell that is opposite to the terminal portion provided with said flange portion, a step is provided of making a plurality of longitudinal dead holes.

In particular, the method for producing a Yankee cylinder provides, furthermore, the steps of:

- positioning of a head at each enlarged terminal portion of said cylindrical shell, each head being provided with a plurality of through holes, at the end of said positioning step each through hole of said plurality being aligned with a respective blind hole of said enlarged terminal portion of said cylindrical shell;
- fixing each said head to a respective enlarged terminal portion of said cylindrical shell by screwing a stud at each couple of aligned blind hole and through hole.

Preferably, the above disclosed stud is a conical stud.

Advantageously, each stud is clamped at a respective head by means of a clamping nut. Preferably, a step is provided of interposing a washer made of copper, in particular made of annealed copper, between the head and the clamping nut, in such a way that, in operating conditions, it is possible to compensate any play.

According to what is provided by the invention, the above disclosed forging step is a lamination carried out by means of at least a first bending roll and a second bending roll arranged, in use, to rotate about respective rotation axes in order to exert their action, respectively, on said opposite surfaces of said wall of said tubular semifinished product. More precisely, the first and the second bending roll are configured in such a way to carry out the first thickness s1 at the central portion of the wall, a second thickness s2 at the terminal portion provided with said flange portion and a third thickness s3 at the opposite portion.

In particular, the step of making the plurality of grooves at the internal surface of the tubular semifinished product is carried out by machining.

Preferably, the step of making a plurality of grooves at the internal surface provides to make an end group of grooves at the first, or the second, terminal portion of each cylindrical portion of the shell. In particular, the end group of grooves comprises at least a first and at least a second circumferential groove having a width l that increases and a depth d that decreases going towards the enlarged terminal portion of the cylindrical portion of the shell. In this way, in operating conditions, it is possible to uniformly distribute the loads along the length of the final shell, i.e. the shell that is obtained coupling the two, or more, portions of the shell.

Advantageously, the step of making the plurality of grooves provides also a step of making a group of grooves that, in the final shell, occupy a central portion between the 2 end groups of grooves. More precisely, the central grooves have all the same width l that is less than the width of the end grooves and the same depth d that is greater than the depth of the end grooves.

In particular, at the end of the forging step, the enlarged terminal portion has a tapered internal surface that delimits a circumferential groove having a width greater than the width of the adjacent end groove and a depth less than its depth.

In an embodiment of the invention, the step of making each end group of grooves provides to make at the internal surface of the tubular semifinished product, a first, a second and at least a third circumferential groove having a width l that increases, and a depth d that decreases going towards the enlarged terminal portion of the shell.

Advantageously, furthermore, the steps are provided of:

disposing of a hollow shaft within the cylindrical shell;

disposing of a first bearing journal at the first head;

disposing of a second bearing journal at the second head;

fixing by bolt coupling the hollow shaft to the first head, to the second head, to the first bearing journal and to the second bearing journal.

BRIEF DESCRIPTION OF THE DRAWINGS

The invention will be now shown with the following description of its exemplary embodiments, exemplifying but not limitative, with reference to the attached drawings in which:

FIG. 6 diagrammatically shows, in section view, a Yankee cylinder produced with the method, according to the invention;

FIG. 7 shows an enlarged view of the contact zone between the shell and the head of the Yankee cylinder of FIG. 6 in order to highlight some characteristics;

FIG. 18 diagrammatically shows the connection zone between the shell and the head of the Yankee cylinder of FIG. 6 in an assembled configuration;

FIG. 19 shows an enlarged view of the circumferential groove that is the closest one to the enlarged terminal portion of the shell;

DETAILED DESCRIPTION OF SOME EMBODIMENTS OF THE INVENTION

Figure 1:
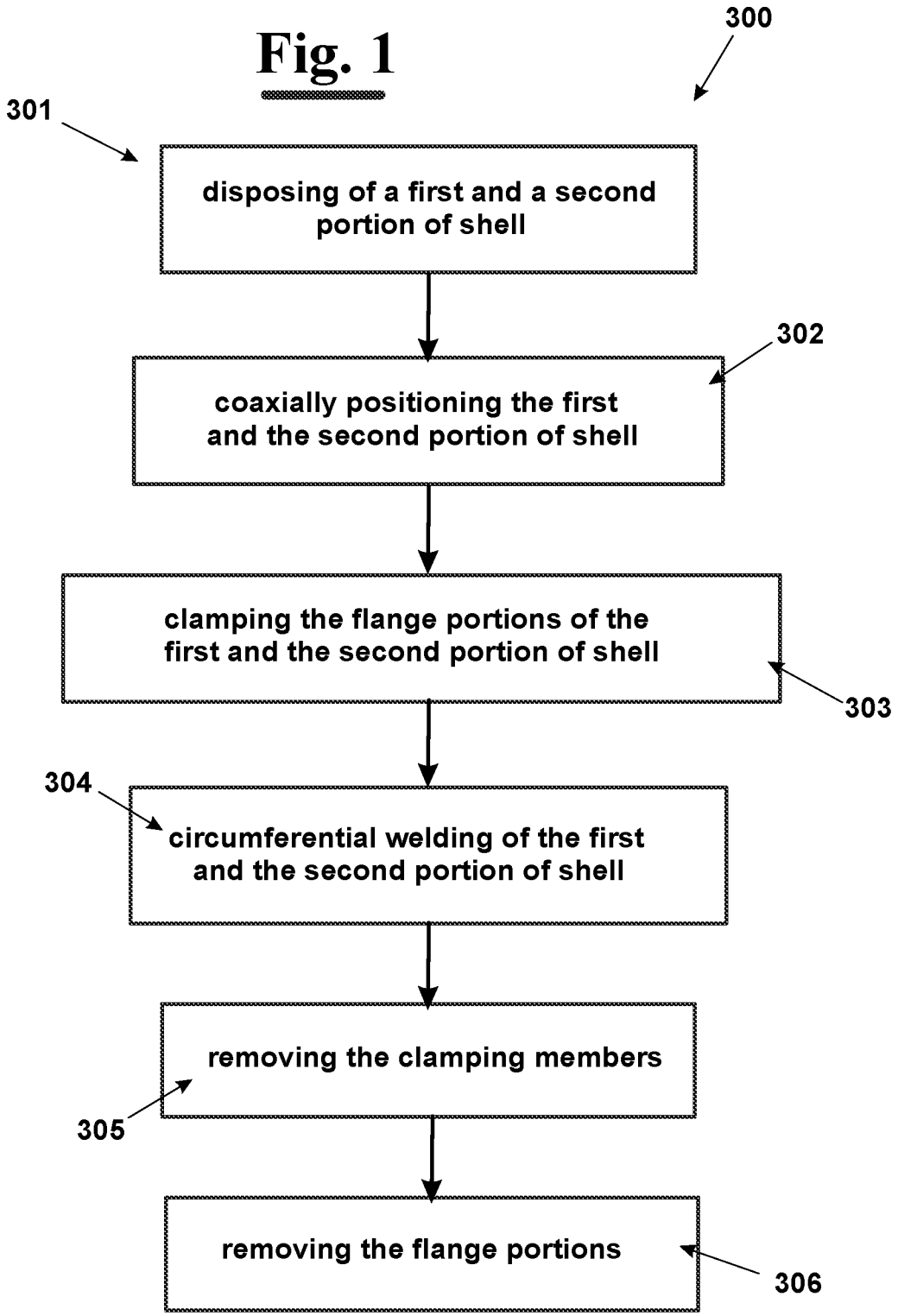
FIG. 1 shows a flow diagram illustrating the main steps of the method, according to the invention, for producing a Yankee cylinder.

As diagrammatically shown in the block-scheme of FIG. 1, the method, according to the invention, for producing a Yankee dryer cylinder, or Yankee cylinder, provides a starting step of disposing of a first and of a second cylindrical portion of shell 10*a* and 10*b*, block 301. More in detail, the portions of shell 10*a* and 10*b* are made of steel and have the same diameter, in particular, the same internal diameter Øin and the same external diameter Ønest. Both the first portion 10*a* and the second portion 10*b* are provided with a plurality of grooves 15 at a respective internal surface 112*a* and 112*b*. These are provided with flange portions 19*a* and 19*b* at respective ends 11*a* and 11*b*. More in detail, the flange portions 19*a* and 19*b* protrudes towards the inside of the respective portion 10*a* and 10*b*. In the embodiment illustrated, for example, in FIG. 2, the flange portions 19*a* and 19*b* are substantially "dovetail" shaped. Each flange portion 19*a* and 19*b* can be made in a single piece, or can comprise many circular sectors. Furthermore, the flange portions 19*a* and 19*b* do not necessarily cover all the circumference of the portions of the shell 10*a* and 10*b*.

Then, a step of coaxially positioning the first and the second cylindrical portion of shell 10*a* and 10*b* follows up to arrange adjacent respective coupling surfaces 29*a* and 29*b* of the flange portions 19*a* and 19*b*, block 302.

The first and the second cylindrical portion of the shell 10*a* and 10*b* are, then, mutually engaged by means of a plurality of clamping members 90, block 303.

As it is shown in detail in the figure, each clamping member 90 is arranged to clamp the adjacent flange portions 19*a* and 19*b*. More in detail, each clamping member 90 can comprise a first part 90*a* that is adjacent, in use, to the flange portion 19*a* of the first portion 10*a* of the shell, and a second part 90*b* that is adjacent, in use, to the flange portion 19*b* of the second portion 10*b* of the shell. The 2 parts 90*a* and 90*b* of the clamping member 90 are, then, fixed to the flange portions 19*a* and 19*b* by means of a bolt 95.

Figure 3:
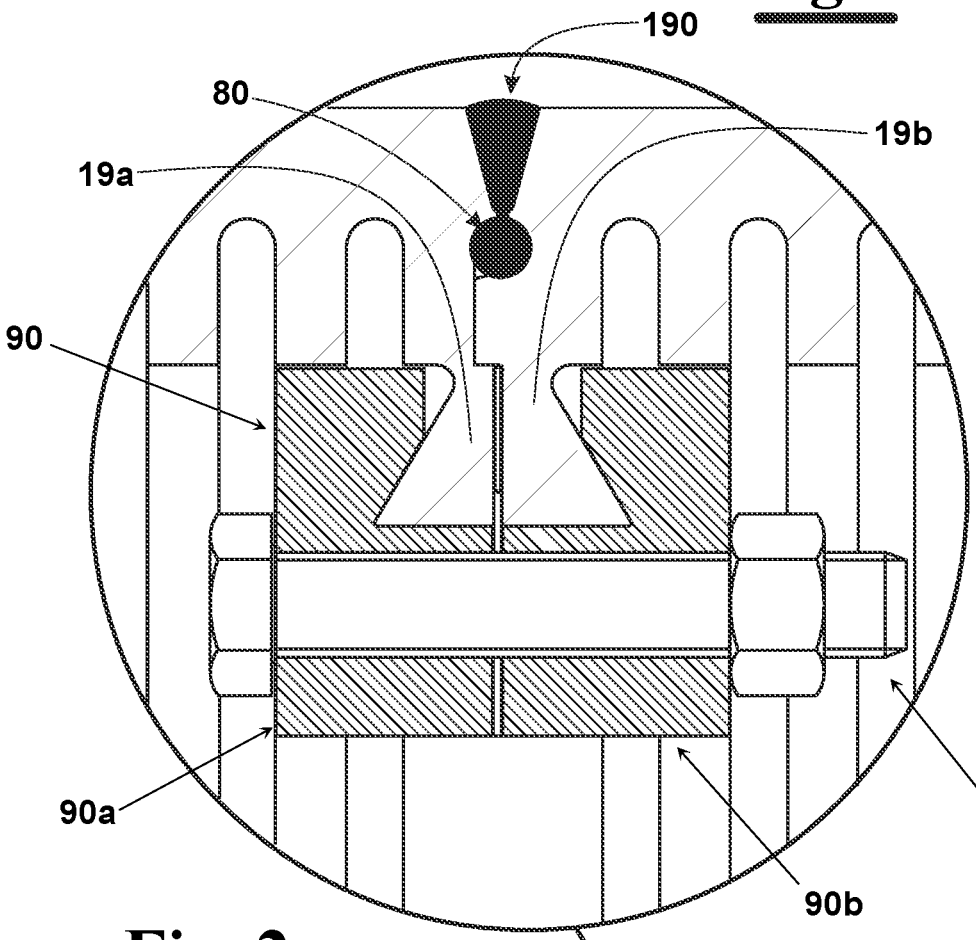
FIG. 3 shows an enlarged view of the contact zone between the 2 portions of shell of the Yankee cylinder of FIG. 2 in order to highlight some characteristics.

Once the 2 portions of shell 10*a* and 10*b* have been clamped to the flange portions 19*a* and 19*b*, a circumferential welding is made, block 304. More in detail, the circumferential welding 190 is made at the opposite side of the flange portions 19*a* and 19*b* (see for example FIG. 3).

Once the circumferential welding 190 is completed, the clamping members 90 are removed, block 305. Then, the flange portions 19*a* and 19*b* are removed, block 306.

This step can be carried out by means of a tool 505, for example a cutter. More in detail, as diagrammatically shown in the figure, a removal machine 500 is provided for removing the above disclosed flange portions 19*a* and 19*b* that is equipped with the above disclosed tool 505. The machine 500 can be provided, in particular, with an engagement portion 501 arranged to engage the shell 10 keeping determined relative positions, and with a working portion 502 provided with the tool 505. More precisely, the engagement portion 501 can be provided with shaped members 503 arranged to engage with the grooves 15 of the shell 10 in order to keep the machine 500 in position during its operation.

Figure 10:
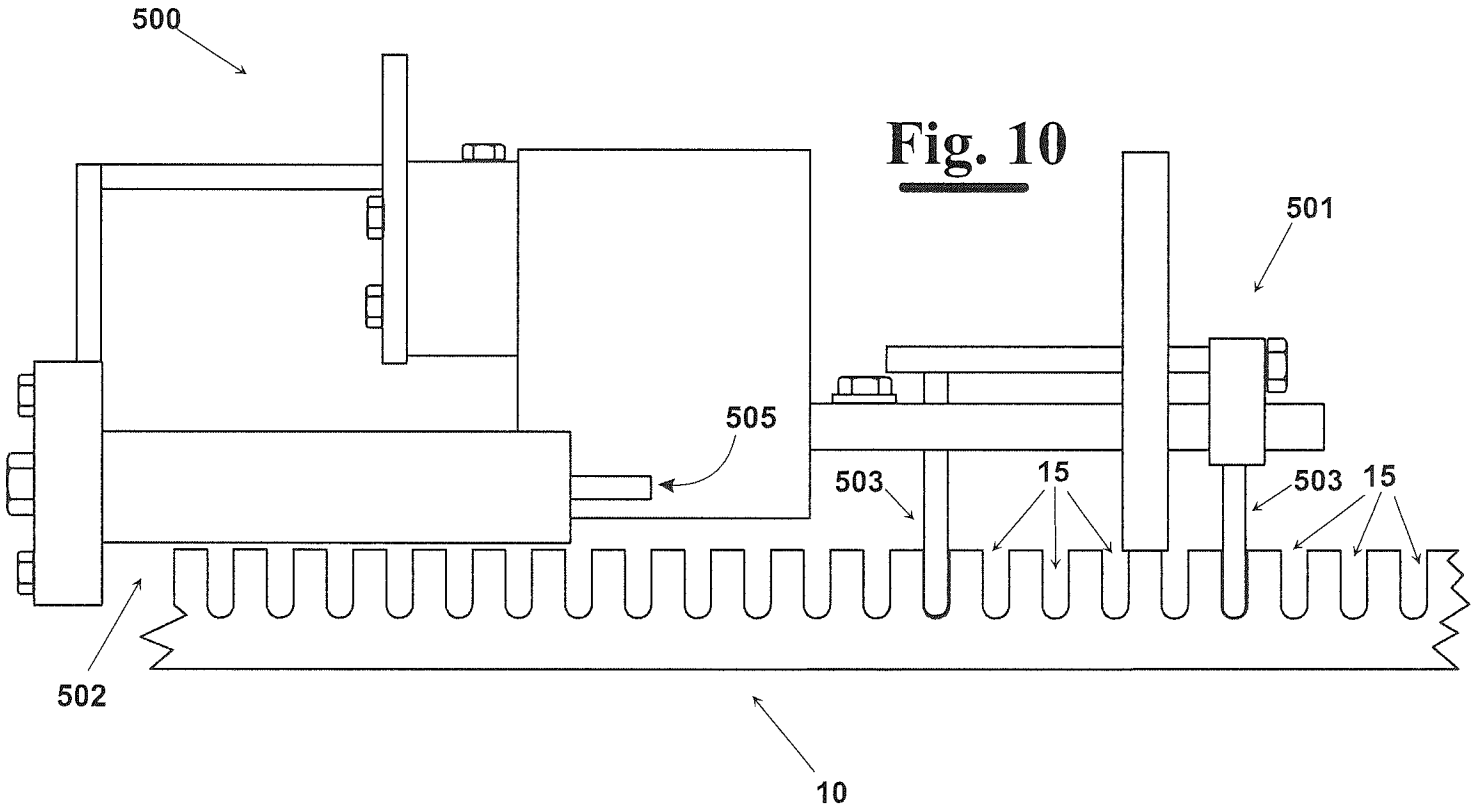
FIG. 10 diagrammatically shows a removing step of the flange portions carried out by a working machine.
Figure 12:
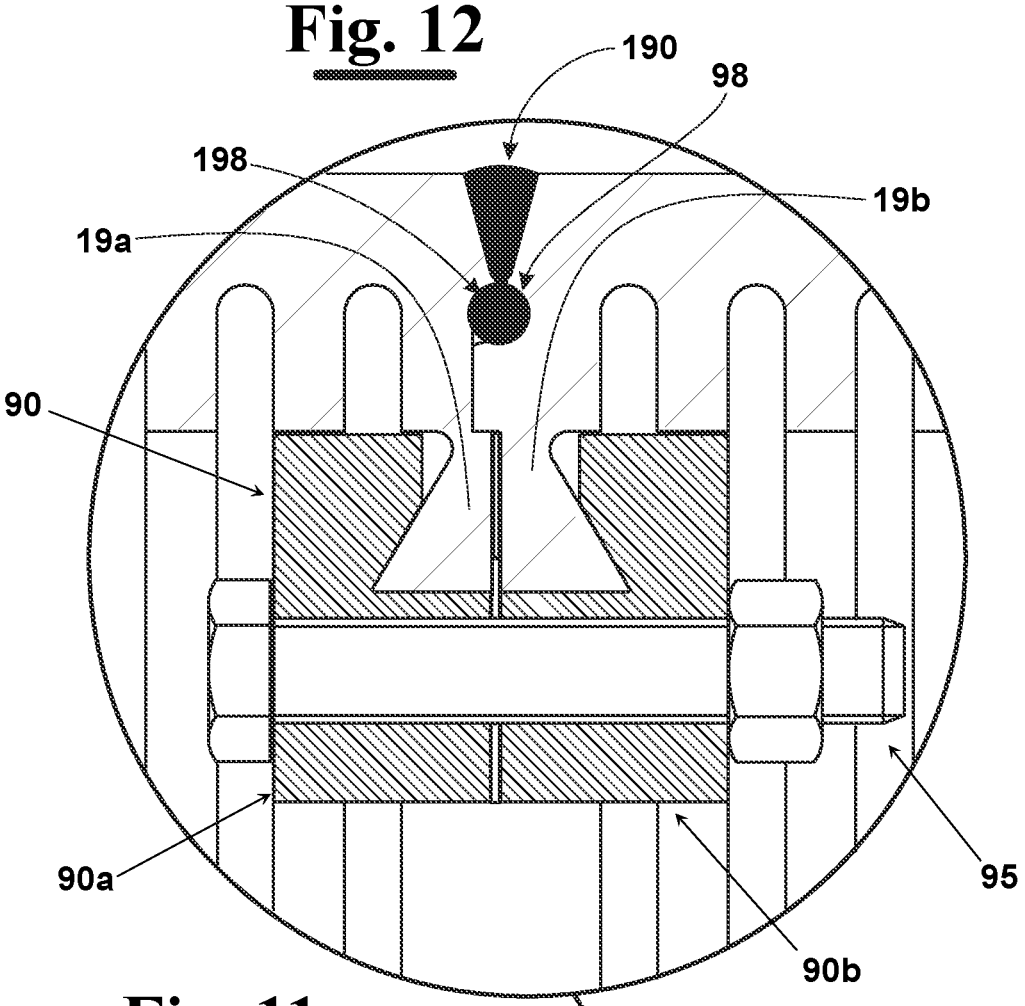
FIG. 12 shows an enlarged view of the contact zone between the two portions of the shell of the Yankee cylinder of FIG. 11 in order to highlight some characteristics.
Figure 11:
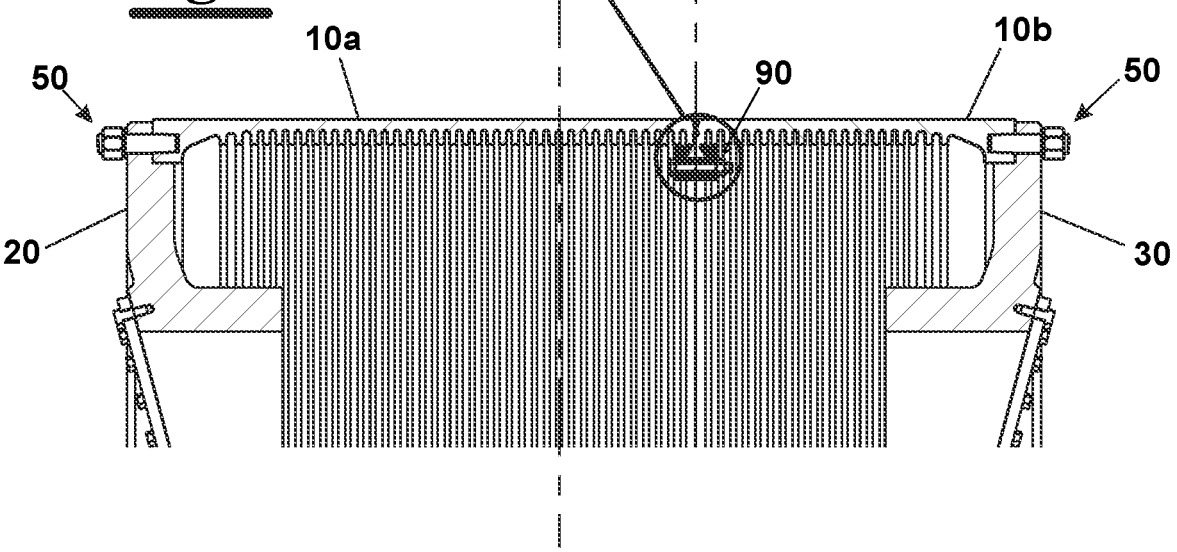
FIG. 11 diagrammatically shows a part of a Yankee cylinder produced with an exemplary embodiment of the method, according to the invention.
Figure 13:
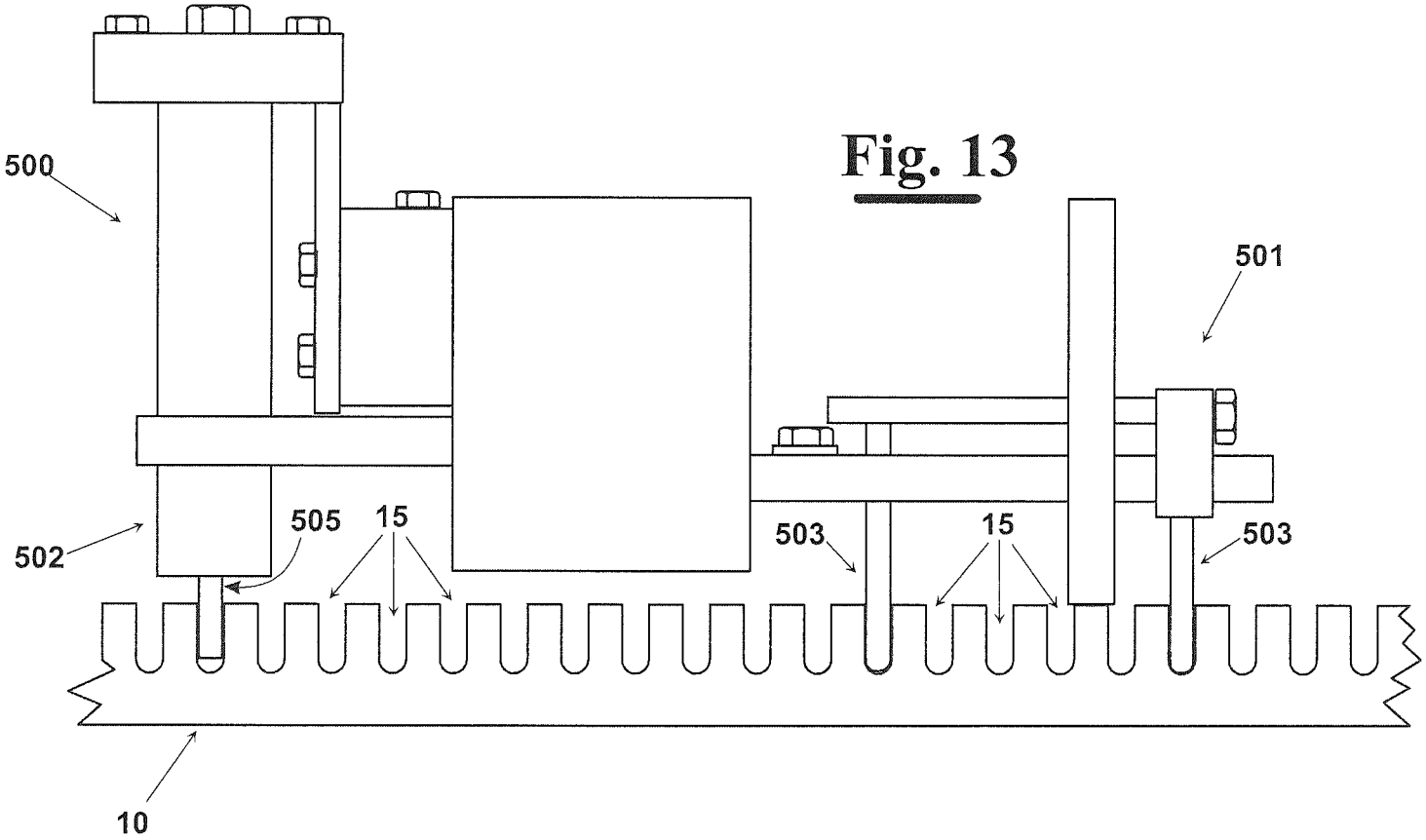
FIG. 13 diagrammatically shows a step of making at least a groove at the coupling zone of the 2 portions of the shell and of breaking of the annular body carried out by the same working machine.
Figure 14:
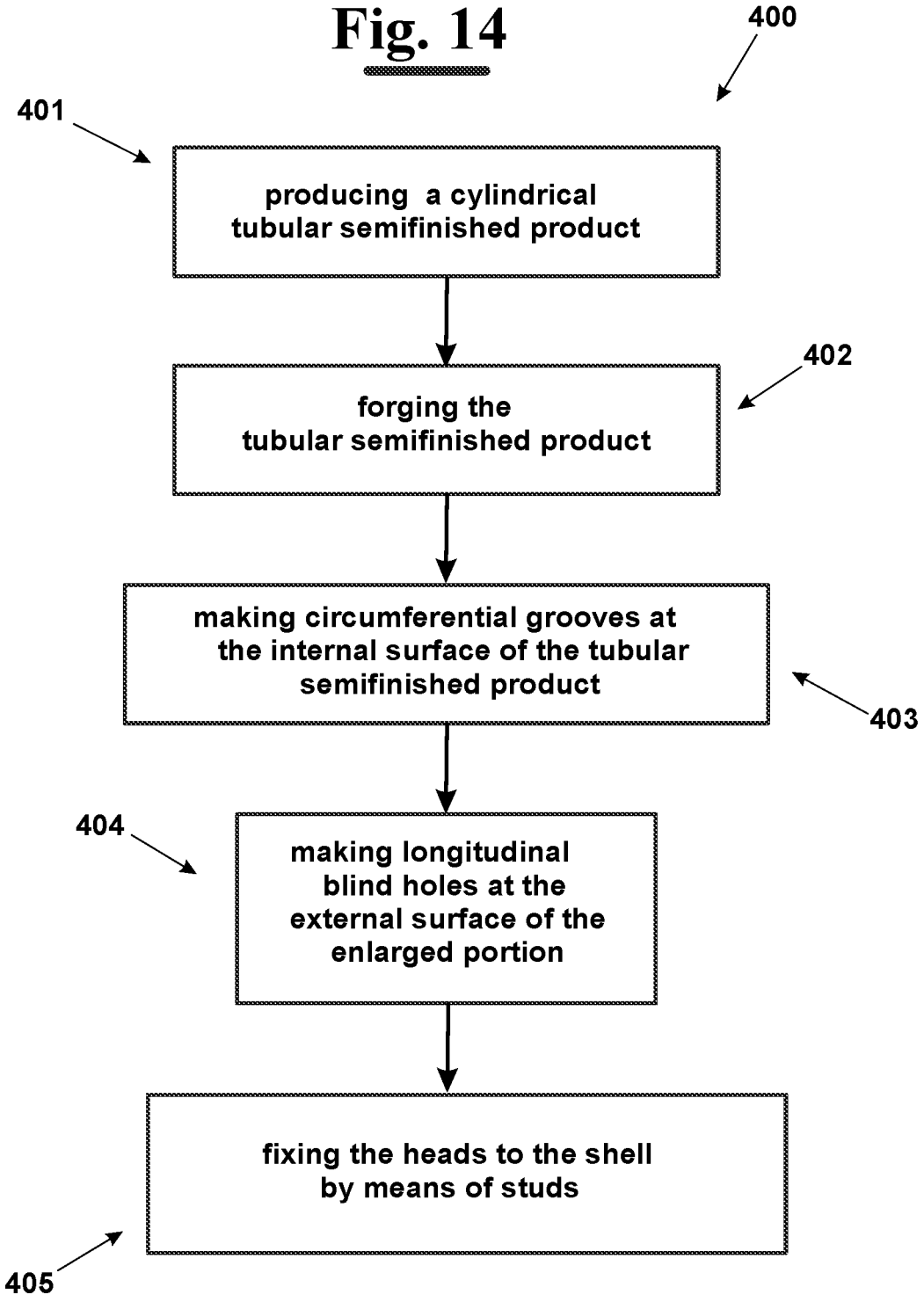
FIG. 14 diagrammatically shows a flow diagram illustrating a possible sequence of steps for obtaining each cylindrical portion of shell.

The working portion 502 can be rotatably connected to the engagement portion 501, in such a way that the tool 505 can be moved with respect to the shell 10. More precisely, during the removing step of the flange portions 19*a* and 19*b*, the tool 505 can be oriented along a substantially axial direction to the shell (FIG. 10), whilst during the step of making of at least a circumferential groove between the coupled ends 11*a* and 11*b*, the tool 505 is oriented along a direction that is substantially orthogonal to the longitudinal axis of the shell 10 (FIG. 13).

According to an exemplary embodiment of the invention, in order to make a very short circumferential welding 190 and avoid shrinkage stresses, before coupling the first and the second cylindrical portion of shell, a step is provided of making a circumferential housing 98 at the coupling surfaces 29*a* and 29*b* of the first and of the second cylindrical portion of the shell 10*a* and 10*b*. Then, a step is provided of positioning an annular body 198, preferably made of ceramic, within the circumferential housing 98.

More precisely, the circumferential housing 98 can be made at one of the 2 ends 11*a*, or 11*b*, of one of the 2 portions 10*a*, or 10*b*, or otherwise can be obtained by making circumferential grooves 97*a* and 97*b* at both the coupling surfaces 29*a* and 29*b*. In this case, the circumferential housing 98 is obtained drawing one end 11*a* near the other end 11*b*, i.e. positioning the 2 circumferential grooves 97*a* and 97*b* facing each other.

The annular body 198 is removed, for example crushing it, once removed the flange portions. More precisely, for crushing the annular body 198 it is possible to use the same tool 505 that is used for removing the flange portions 19*a* and 19*b*.

As shown in detail in the figure, the first and the second cylindrical portion of shell 10*a* and 10*b* have different axial dimensions. More precisely, the length l1 of the first portion 10*a* is different, for example, greater than the length l2 of the second cylindrical portion of shell the 10*b*, i.e. $l1 \neq l2$. This, in order to avoid that the welding is carried out along the centre line 115 of the shell 10 of the Yankee dryer cylinder 1.

According to what is provided by the invention, each cylindrical portion of shell 10*a*, or 10*b*, is obtained through the steps indicated in the block-scheme 400 of figure.

As shown in the block-scheme 400, each cylindrical portion of shell 10*a*, or 10*b*, is made starting from a tubular semifinished product 110 made of steel. This is provided with a side wall 111 having an internal surface 112 and an external surface 113, block 401. A forging step follows of the tubular semifinished product 110 up to obtain a first predetermined thickness s1 at a central portion 111*a* of the side wall 111 and a second predetermined thickness s2, with $s2 > s1$, at opposite terminal portions 111*b*, 111*c* of the side wall 111, block 402. The two opposite ends can have a different thickness, that means a thickness s2 at the portion 11*a*, or 11*b*, where they are provided with the flange portions 19*a* and 19*b*, and a thickness s3, which is different from s2, at the opposite portion 12*a*, or 12*b* that has to be coupled to the head 30, or 20, respectively.

In this way a tubular semifinished product 110 is obtained that has enlarged terminal portions 111*b*, 111*c*. Then, a step is provided of making a plurality of grooves 15 at the internal surface 112 of the tubular semifinished product 110, obtaining a cylindrical portion of cylindrical shell 10*a*, or 10*b*, of the shell 10 of the Yankee dryer cylinder 1, block 402. In particular, the circumferential grooves 15 are made by machining. As known, in use, in the circumferential grooves 15 collects the condensate, which is formed for the transfer towards the outside of the latent heat of vaporization from the steam that has been introduced inside the body of the Yankee cylinder 1.

According to the invention a step is, furthermore, provided of making a plurality of longitudinal dead holes 17 at the external surface 14, 16 of the enlarged terminal portions 111*b*, 111*c* of the cylindrical shell 10, block 403.

Then, the heads 20 and 30 are positioned at the opposite enlarged terminal portions of the cylindrical shell 10, and fixed to the shell 10 by means of studs 50, block 404. More precisely, each head 20,30 is provided with a plurality of through holes 27 each of which, in use, is aligned with a respective blind hole 17. Therefore, the coupling of the heads 20 and 30 to the shell 10 is carried out by screwing the studs 50 in the holes 17 and 27 positioned aligned, block 405.

Once the fixing of the portions 10*a* and 10*b* has been carried out, and the shell 10 is obtained, the dryer cylinder 1 is, then, completed positioning a hollow shaft 40 within the cylindrical shell 10, coaxially to it, a first bearing journal 70, at the first head 20, and a second bearing journal 80, at the second head 30. In particular, a first end of each bearing journal 70, 80 is housed, in use, in a hole of a respective head 20, or 30, whilst the opposite end is mounted within a bearing 75, or 85. The hollow shaft 40 is then fixed to the heads 20 and 30 and to the bearing journals 70 and 80 by bolt coupling.

Figure 17:
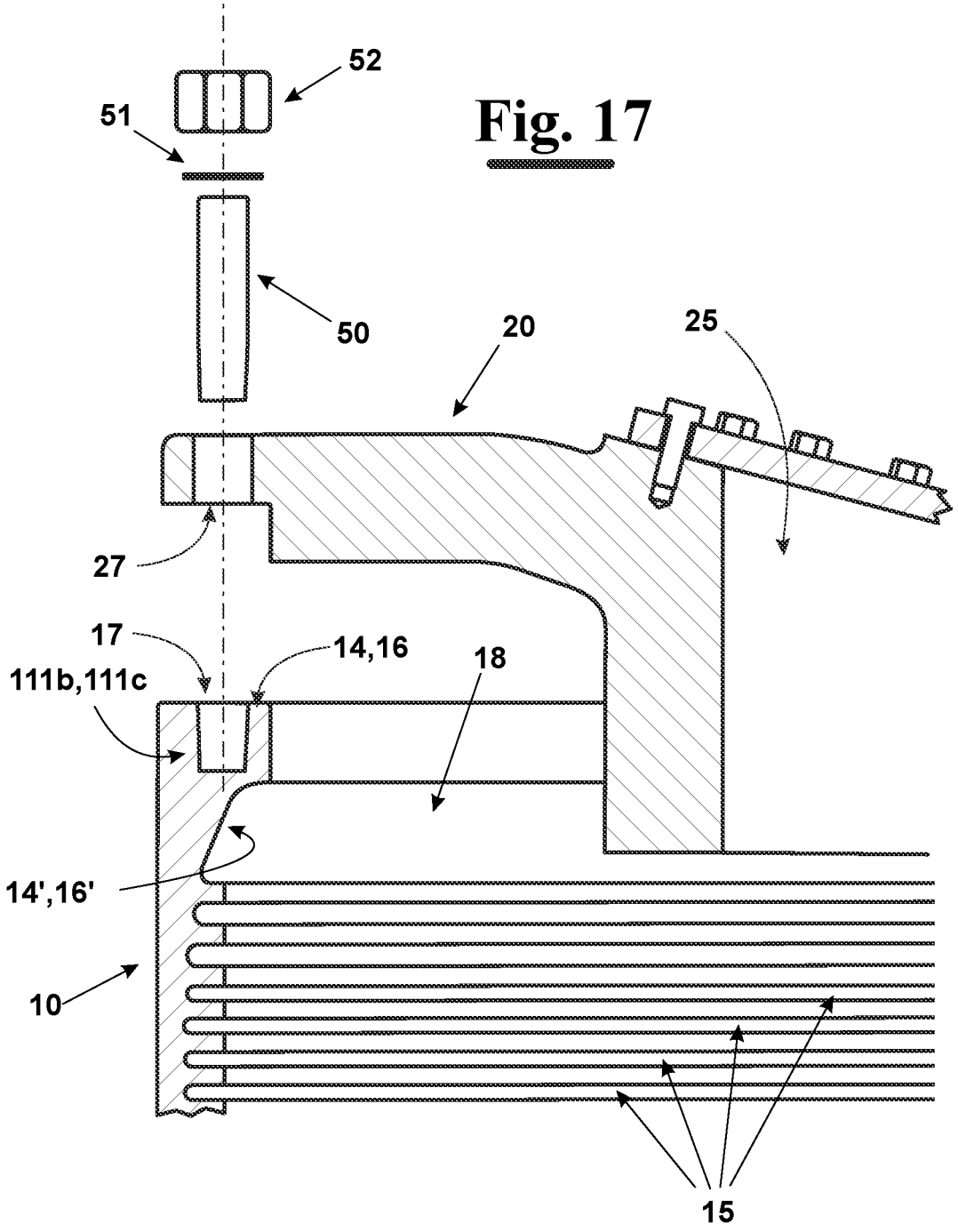
FIG. 17 diagrammatically shows in an exploded view, the connection zone between the shell and the head of the Yankee cylinder produced by the method, according to the invention.
Figure 20:
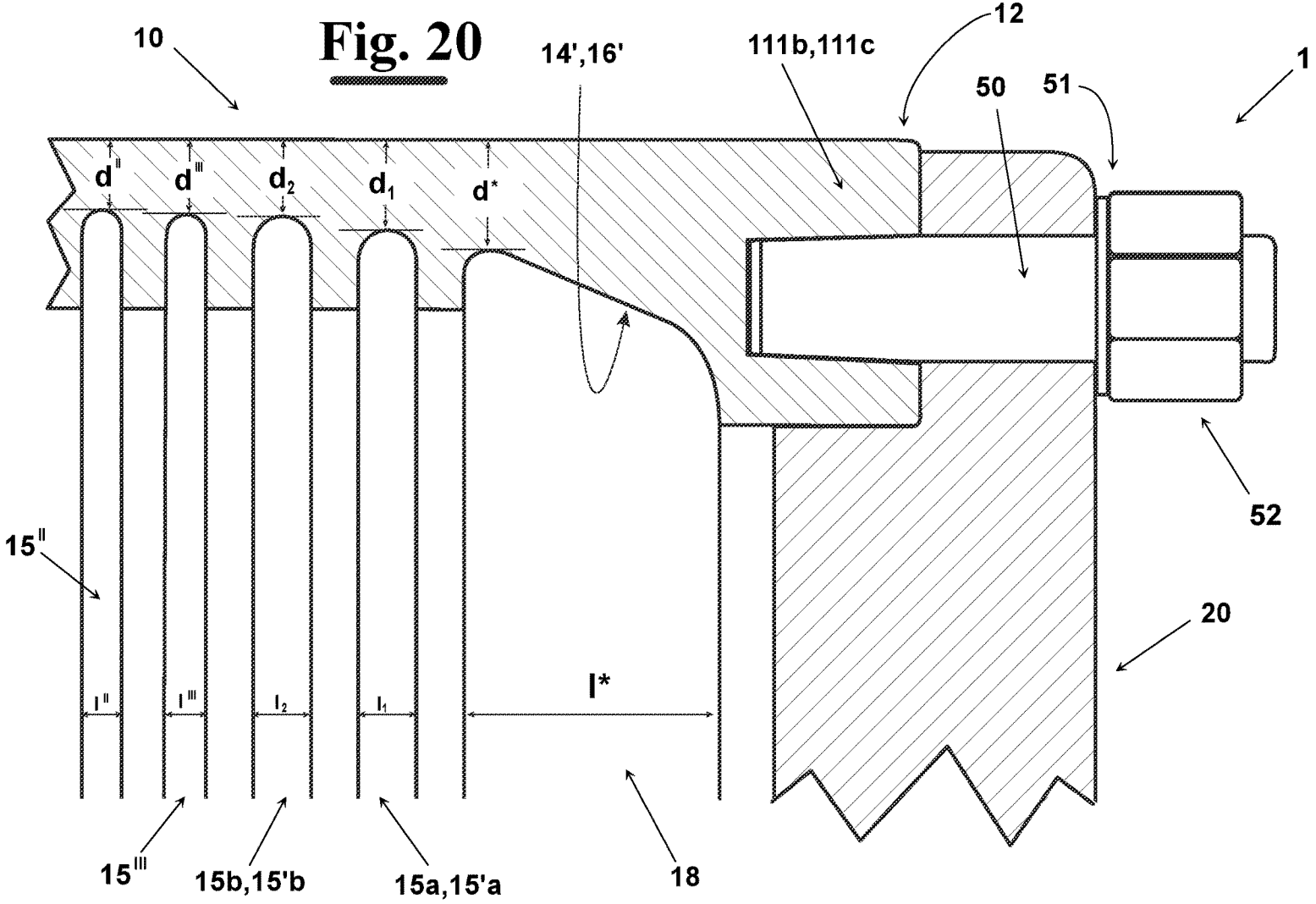
FIG. 20 diagrammatically shows in a section view the contact zone between the shell and the head of an exemplary embodiment of the Yankee cylinder that can be produced using the method, according to the invention.

As shown in detail in the FIGS. 17, 18 and 20, the studs used for fixing the shell 10 to the heads 20 and 30 are preferably conical studs 50. More precisely, each stud 50 is clamped to a respective head 20, or 30, by means of a clamping nut 52. Between each clamping nut 52 and the surface of head 20, or 30, a step is provided of interposing a washer made of annealed copper 51. This particular solution allows, in operating conditions, to compensate any play.

The technical solution provided by the present invention allows to distribute more uniformly the stresses, in particular the thermoelastic stresses, the pressure stresses and the stresses that are due to the centrifugal force, allowing to increase the performances and the service life of the Yankee cylinder.

In fact, in operating conditions, the pressure tends to deform differently both the shell and the heads. Therefore, the contact zones between the shell and the heads are the most stressed zones.

For the above discussed reasons, at the connection zones between the shell and the heads the stresses, to which the Yankee cylinder is subjected, concentrate and, therefore, in operating conditions, cracks and slits can happen that can cause, over time, the structure to be broken.

The solution provided by the present invention, instead, allows to increase the thickness of the shell at the terminal portions and at the same time to avoid to introduce elements that weaken the structure as for example welds, or protruding portions of screws. Therefore, in operating conditions, a more uniform distribution of the loads is achieved. A further advantage of using the studs, with respect to the using of the traditional through screws, is to avoid trapping of the air in the hole within which the screw is screwed. In fact, the presence of air within the holes, or the hollows, of the structure can cause cracks and slits, because of the high temperatures at which the Yankee cylinders work, the pressure of the air increases thus producing concentrated stresses.

Figure 15:
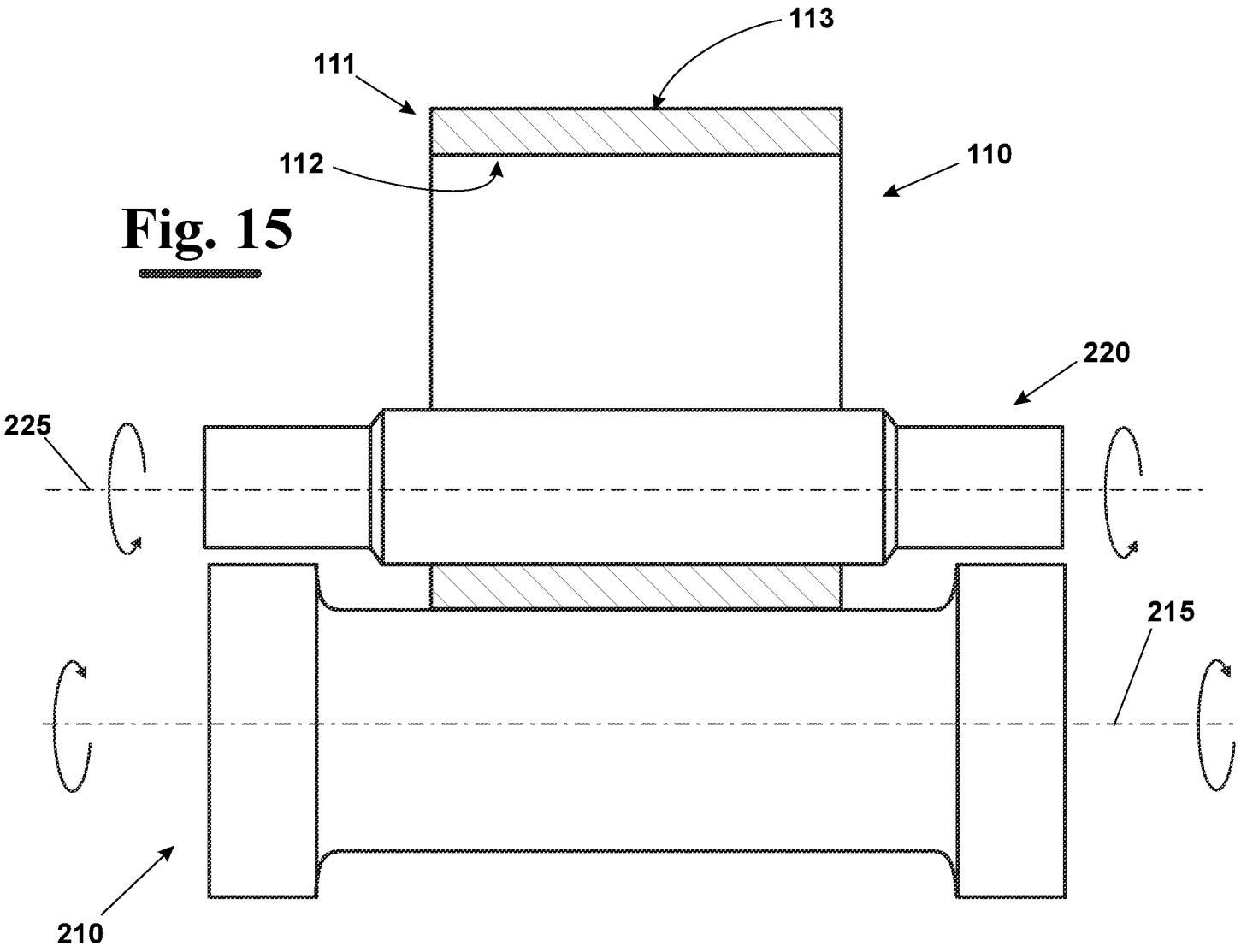
FIGS. 15 and 16 diagrammatically show 2 instants of the rolling step to which the starting semifinished product is subjected for obtaining the portions of the shell.
Figure 16:
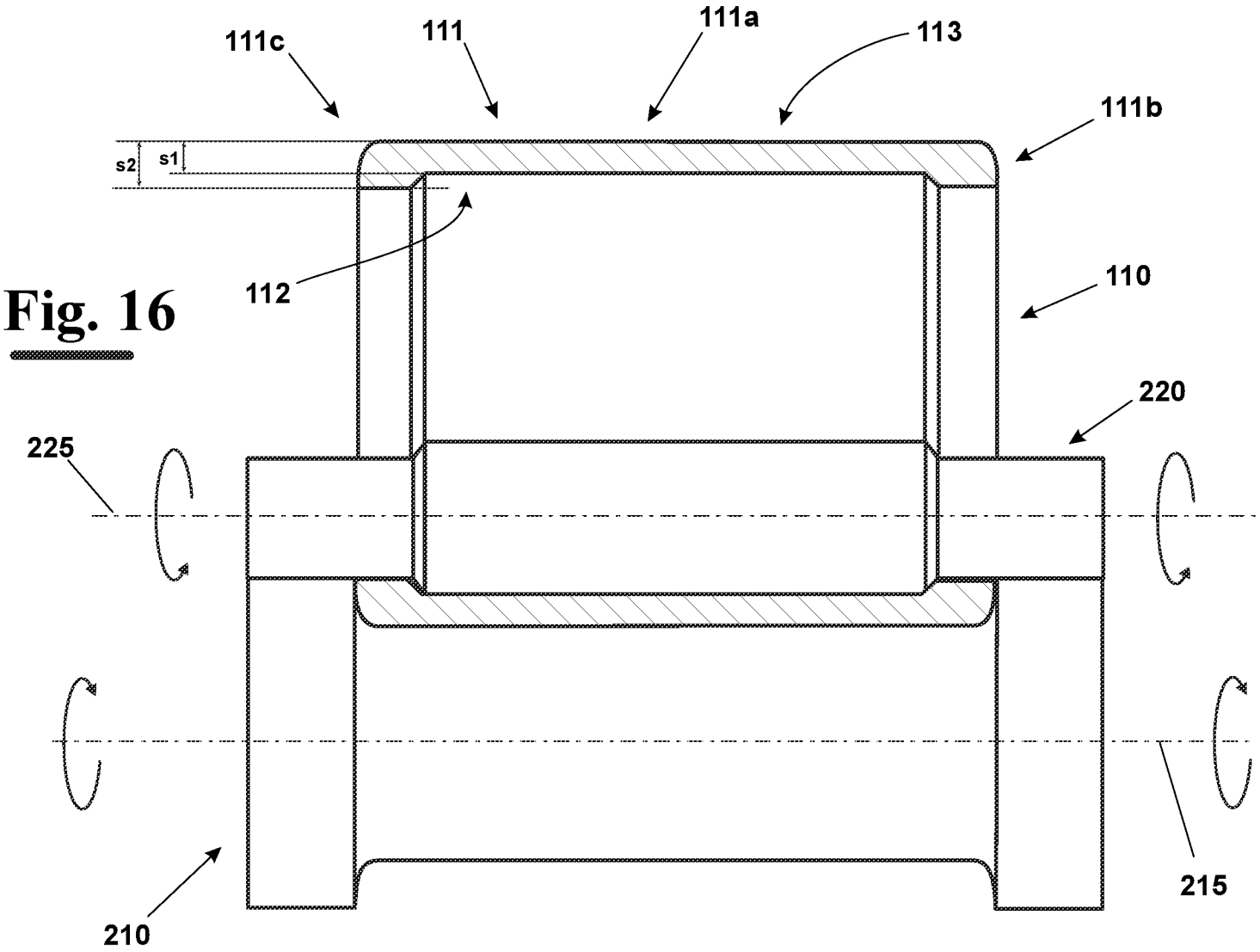

As diagrammatically illustrated in FIGS. 15 and 16, the above disclosed forging step provides a rolling carried out by means of at least a first bending roll 210 and a second bending roll 220 arranged, in use, to rotate about respective rotation axes 215 and 225 in order to exert their action at the respective opposite surfaces 112 and 113 of the wall 111 of the tubular semifinished product 110. More precisely, the bending rolls 210 and 220 are configured in such a way that, during the rolling step, the thickness s of the tubular semifinished product 110 is reduced to a first value s1 at a central portion and to a second thickness. Alternatively, using specific bending rolls, it is possible to obtain, as above disclosed in detail, a second thickness s2 and a third thickness s3, at the opposite terminal portions 11*a* and 11*b*, or 12*a* and 12*b*.

As diagrammatically shown in particular in FIG. 20, the step of making a plurality of grooves 15 at the internal surface 112 provides to make an end group of grooves at the terminal portion 12*a*, or at the terminal portion 12*b*, of the first, or of the second, cylindrical portion of shell 10*a*, or 10*b*. In particular, the end group of grooves comprises at least a first and at least a second circumferential groove 15*a*, or 15*b*, and 15'*a*, or 15'*b* having a width l which increases. More precisely if with $l_1$ is indicated the width of the groove 15*a* and with $l_2$ is indicated the width of the groove 15*b*, it is $l1>l_2$. Furthermore, the circumferential end grooves 15*a*, or 15*b*, and 15'*a*, or 15'*b* have a depth d that decreases going towards the enlarged terminal portions 12*a* and 12*b* of the shell 10 obtained by coupling the 2 portions of shell 10*a* and 10*b*. Therefore, if $d_1$ is the depth of the groove 15*a* and $d_2$ is the width of the groove 15*b*, it is $d1>d_2$.

This particular geometry of the circumferential grooves 15 together with the absence of welds, or flange portions at the side of the shell 10 of screws, or bolts, allows to optimize the performances of the Yankee cylinder 1 with respect to the Yankee cylinders of prior art.

Between the first and the second end group of grooves of the final shell 10, a group is provided of central grooves 15 all having the same width l, that is less than the width of the end grooves, and the same depth d that is greater than the depth of the end grooves.

At the end of the forging step, the enlarged terminal portion 111*b*, 111*c* has a tapered internal surface 14', 16' arranged to delimit a groove 18 having a width l that is greater than the width of the adjacent end groove and a depth d that is less than its depth.

An embodiment of the invention provides, furthermore, the step of making the plurality of grooves 15 at the internal surface 112 provides to make a first 15*a*, 15'a, a second 15*b*, 15'*b*, and at least a third circumferential groove 15*c*, 15'*c* having a width l that increases and a depth d that decreases going towards the enlarged terminal portion 12*a*, or 12*b*, of the final shell 10.

According to an advantageous exemplary embodiment of the invention, each head 20, 30 comprises a central lowered portion 21, 31 that is lowered towards the inside of the Yankee cylinder 1 and an terminal portion 22, 32 connected to the central lowered portion 21, 31 by means of a connection portion 23, 33. This can be substantially flat, or curvilinear, i.e. substantially concave. At the connection portion 23, 33 of a head 20, 30, at least one inspection aperture 25 can be provided for example 2 inspection apertures. These ensure that, during the assembling, or maintenance, operations, the staff can work in safety. In a possible embodiment, each connection portion of each head is provided with 2 inspection apertures arranged at 180°.

In particular, each inspection aperture 25 has a tubular shape. The tubular shape of the inspection apertures 25 to simplify and improve dynamic balancing of the whole structure and to help the staff to enter inside the Yankee dryer cylinder 1. The tubular entrance of the inspection apertures, furthermore, increases the structural stiffness of the head and therefore of the whole Yankee cylinder.

Figure 8:
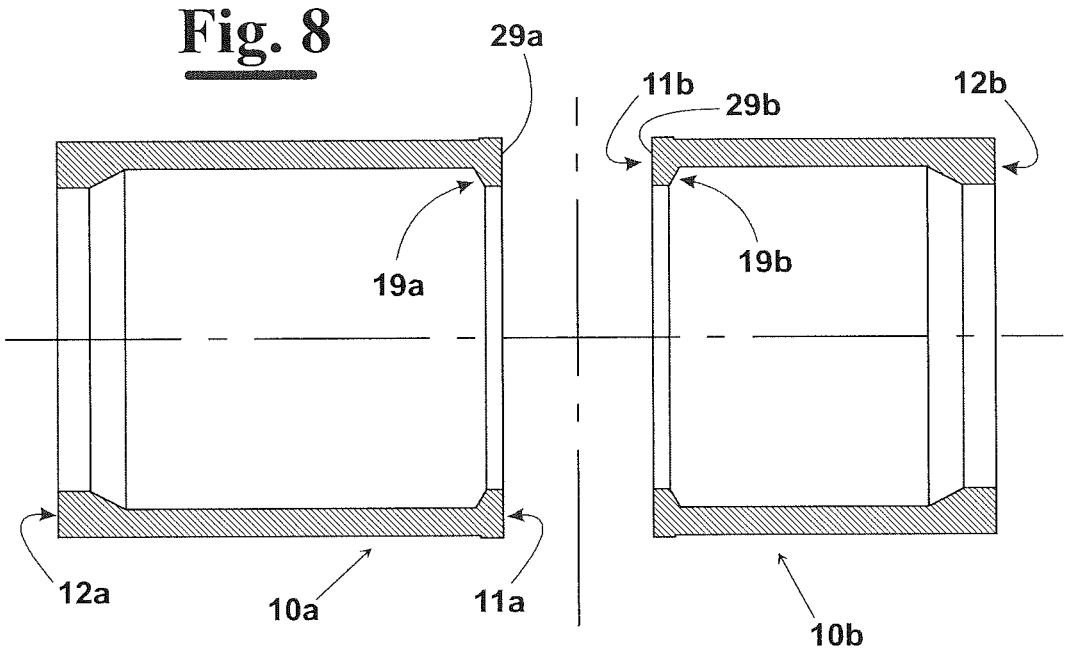
FIGS. 8 and 9 diagrammatically show 2 instants of the production step of the shell, according to the invention, in particular the coaxially positioning step of the 2 portions of shell and the step of disposing them adjacent one to the other.

As shown in detail in FIG. 8, at least the end circumferential grooves 15 have a curvilinear profile. According to another aspect of the invention, at least these circumferential grooves 15 have a radius of curvature r that is greater than the radius of curvature r" of the circumferential grooves 15 positioned at the central portion 11 of the cylindrical shell 10, i.e. r>r". More in detail, the radius of curvature r of the first and of the second circumferential groove 15*a*, 15*b* and 15'*a*, 15'*b* of the first and of the second group is set between 9.5 and 10.5 mm, e.g. r=10 mm.

Figure 9:
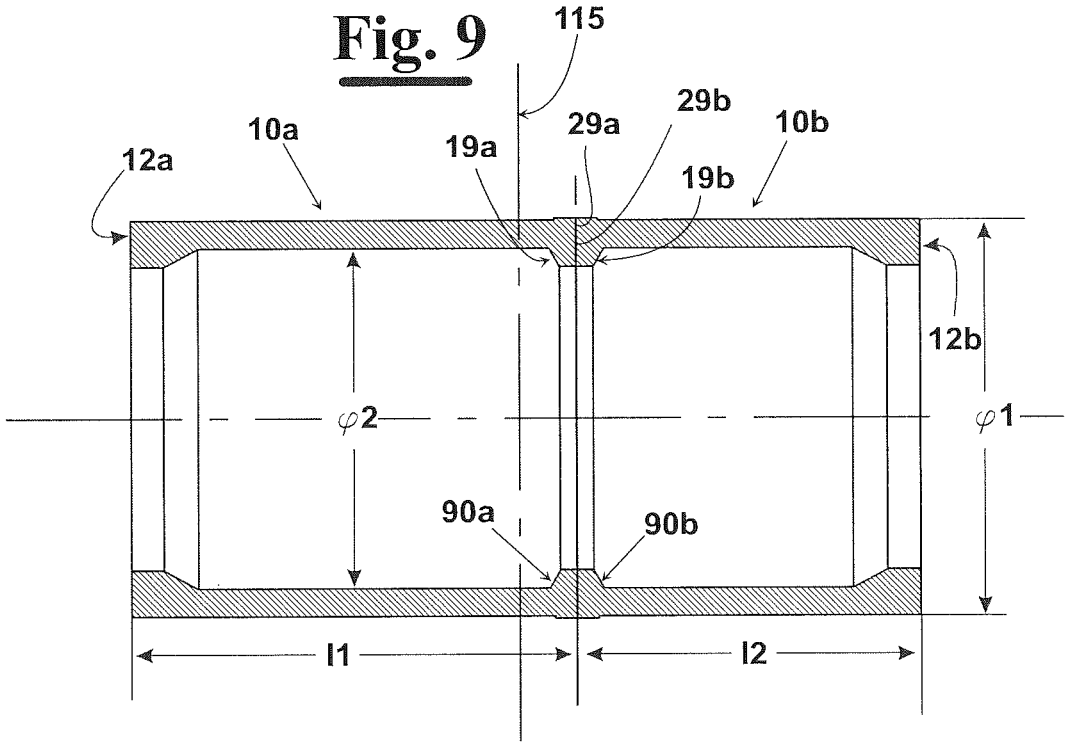

As shown, for example in FIG. 9, between each group of circumferential end grooves 15 and the central grooves 15", a group is provided of intermediate circumferential grooves 15'". In particular, the group of intermediate grooves 15'" comprises at least a circumferential groove having a width l'" that is equal to the width l" of the grooves 15 of the central portion 11, but a depth d that is set between the depth of the end circumferential groove 15*b*, or 15'*b*, to it adjacent and the depth of the circumferential central grooves 15". In a foreseen embodiment, also the circumferential grooves 15' of the group of intermediate grooves have a curvilinear shape. In particular, the circumferential grooves 15" of the group of intermediate grooves can have a radius of curvature r'" set between 6 and 7 mm, preferably r'"=6.4 mm. Also the circumferential grooves 15" positioned at the central portion 11 of the cylindrical shell can have a radius of curvature r" set between 6 and 7 mm, preferably r"=6.4 mm.

Concerning the depth of the first circumferential end grooves 15*a* and 15'*a*, it has been demonstrated that the best conditions are obtained with a depth d1 set between 25 and 27 mm, preferably d1=26 mm. Analogously, the second circumferential grooves 15*b*, 15'*b* of the first and of the second group have preferably a depth d2 set between 30 and 32 mm, preferably d2=31 mm.

According to an exemplary embodiment of the invention, the circumferential grooves 15'" of the group of intermediate grooves have a depth d'" set between 31 and 33 mm, preferably a depth d'"=32 mm.

Figure 2:
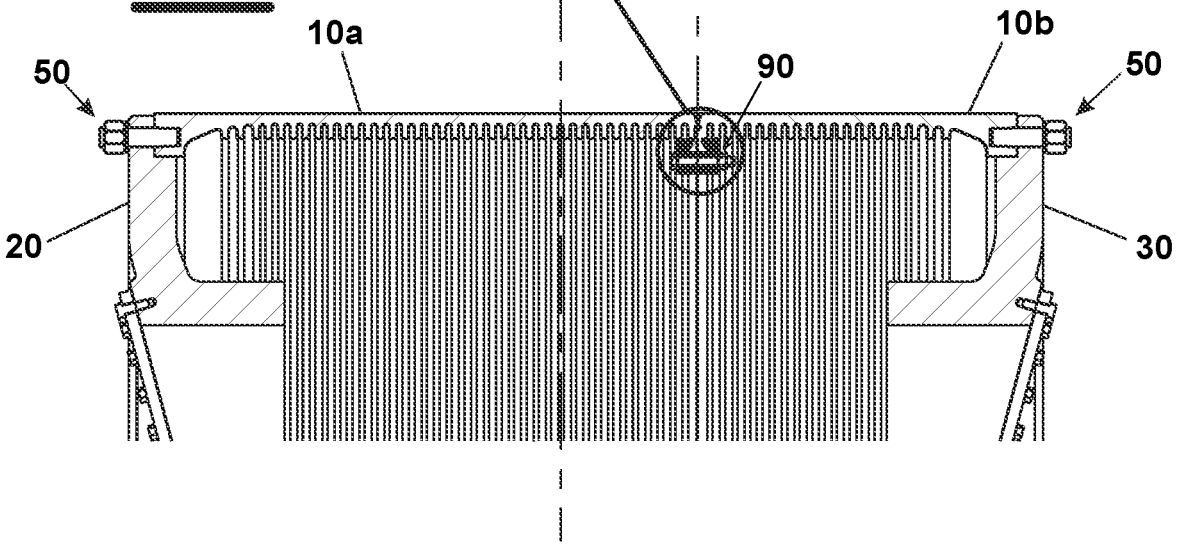
FIG. 2 diagrammatically shows a part of a Yankee cylinder produced by the method, according to the invention.
Figure 5:
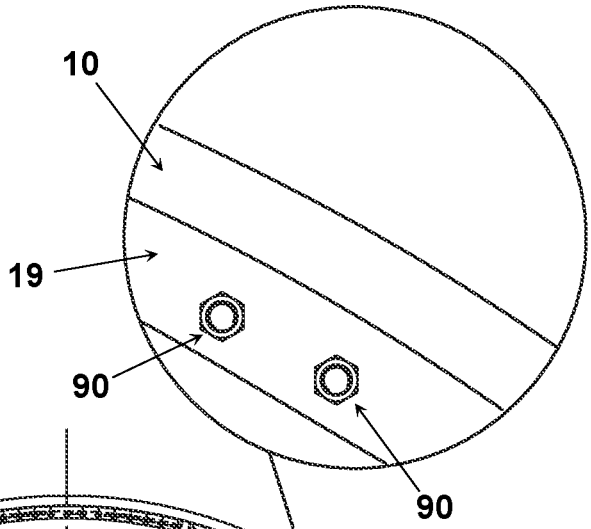
FIG. 5 shows an enlargement of FIG. 4 in order to highlight some characteristics.
Figure 4:
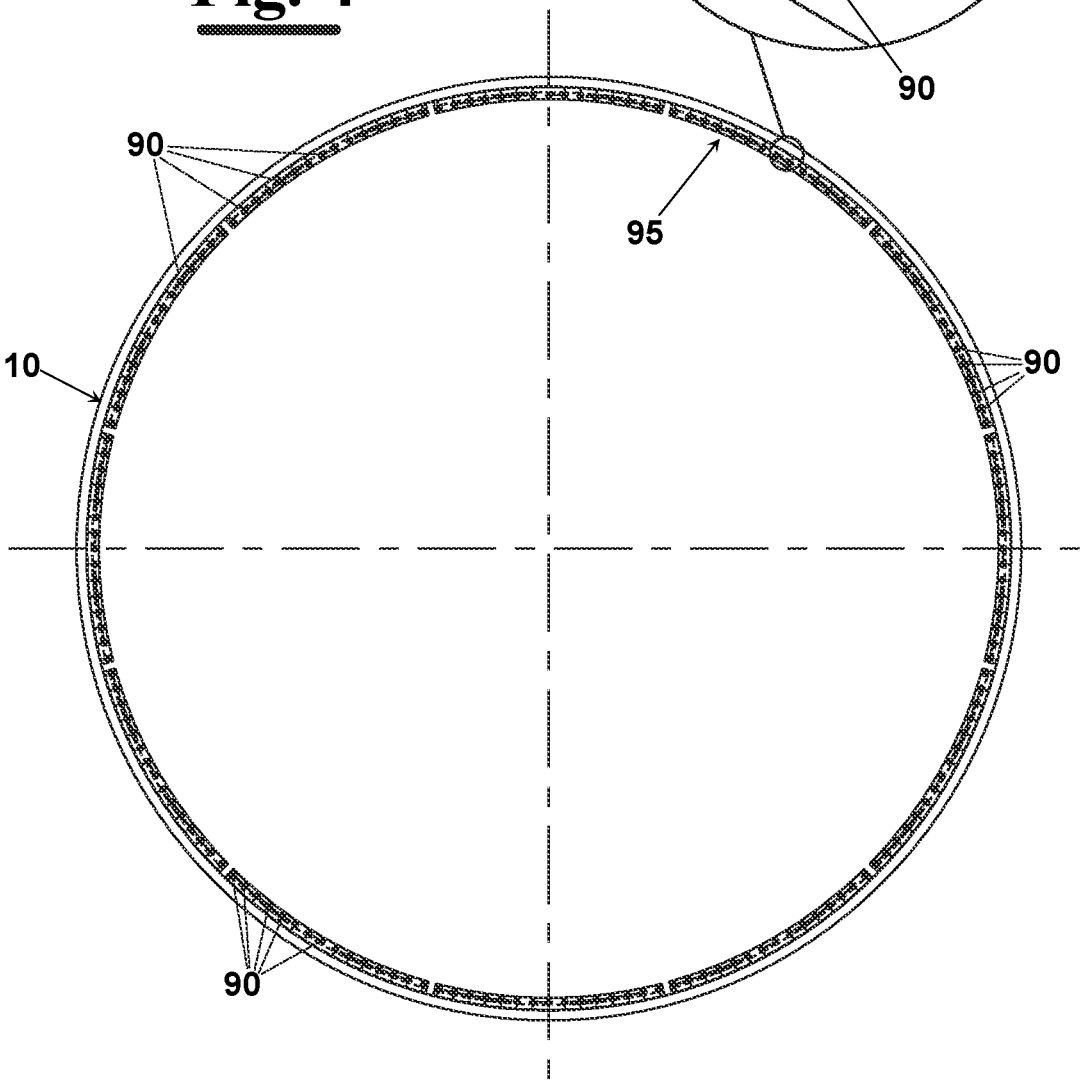
FIG. 4 diagrammatically shows a cross section view of the shell during a production step of the same in order to highlight some characteristics.

As shown, for example, in FIG. 2, the depth increases along the first 4 grooves, i.e. d">d'">d2>d1. All the grooves 15" of the central portion 11 have the same depth d", for example d"=33 mm.

The foregoing description exemplary embodiments of the invention will so fully reveal the invention according to the conceptual point of view, so that others, by applying current knowledge, will be able to modify and/or adapt for various applications such embodiment without further research and without parting from the invention, and, accordingly, it is therefore to be understood that such adaptations and modifications will have to be considered as equivalent to the specific embodiments. The means and the materials to realise the different functions described herein could have a different nature without, for this reason, departing from the field of the invention. It is to be understood that the phraseology or terminology that is employed herein is for the purpose of description and not of limitation.

The invention claimed is:

1. Method for producing a Yankee dryer cylinder, or Yankee cylinder, comprising the steps of:

disposing of a first and at least a second cylindrical portion of shell of said Yankee dryer cylinder, said first and second cylindrical portion of shell being made of steel and having a same diameter, said first and second cylindrical portion of shell having a respective internal surface provided with a plurality of circumferential grooves and of a respective flange portion at a respective end;

coaxially positioning said first and second cylindrical portion of shell up to arrange respective coupling surfaces of said flange portions adjacent one to the other;

engaging said first and second cylindrical portion of shell by means of a plurality of clamping members, each clamping member of said plurality being arranged to clamp said adjacent flange portions;

circumferential welding of said engaged first and second cylindrical portion of shell at the opposite side of said flange portions;

removing said plurality of clamping members;

removing the flange portions.

2. Method for producing a Yankee dryer cylinder, or Yankee cylinder, according to claim 1, wherein said coupling surfaces of the flange portions of said first and second cylindrical portion of shell are configured in such a way to provide a fixed joint.

3. Method for producing a Yankee dryer cylinder, or Yankee cylinder, according to claim 1, wherein, before the positioning step of said first and second cylindrical portion of shell, a step is provided of making a circumferential housing between said coupling surfaces of said flange portions, said circumferential housing being arranged, in use, to house an annular body, which is removed once said flange portions are removed.

4. Method for producing a Yankee dryer cylinder, or Yankee cylinder, according to claim 3, wherein the annular body is made of ceramic.

5. Method for producing a Yankee dryer cylinder, or Yankee cylinder, according to claim 1, wherein, once said removing step of said flange portions has been carried out, a step is provided of making at least a circumferential groove between said coupled ends of said first and second cylindrical portion of shell.

6. Method for producing a Yankee dryer cylinder, or Yankee cylinder, according to claim 5, wherein said removing step of said flange portions and/or said step of making said groove between said coupled ends of said first and second cylindrical portion of shell, and/or said step of removing said annular body is carried out by means of a removal machine comprising an engagement portion engaging said shell and a working portion provided with a tool.

7. Method for producing a Yankee dryer cylinder, or Yankee cylinder, according to claim 1, wherein both said first and said second cylindrical portion of shell are obtained through the steps of:

disposing of un tubular semifinished product made of steel having a side wall provided with an internal surface and an external surface;

forging said tubular semifinished product up to obtain a first predetermined thickness s1 at a central portion of said side wall and predetermined thickness greater than said first thickness s1 at the enlarged terminal portions;

making a plurality of circumferential grooves at said internal surface of said tubular semifinished product obtaining said first, or said second, cylindrical portion of shell.

8. Method for producing a Yankee dryer cylinder, or Yankee cylinder, according to claim 7, wherein, at said enlarged portion of said cylindrical portion of shell opposite to said terminal portion provided with said flange portion, a step is provided of making a plurality of longitudinal dead holes and wherein, furthermore, the steps are provided of:

positioning a head at each enlarged terminal portions of said cylindrical shell, each head being provided with a plurality of through holes, at the end of said step of positioning, each through hole of said plurality being aligned with a respective blind hole of said enlarged terminal portion of said cylindrical shell;

fixing each said head to a respective enlarged terminal portion of said cylindrical shell by screwing a stud at each couple of aligned blind hole and through hole.

9. Method for producing a Yankee dryer cylinder, or Yankee cylinder, according to claim 8, wherein, furthermore, the steps are provided of:

disposing of a hollow shaft within said cylindrical shell;

disposing of a first bearing journal at said first head disposing of a second bearing journal at said second head;

fixing by bolt coupling said hollow shaft to said first head, to said second head, to said first bearing journal and to said second bearing journal.

10. Method for producing a Yankee dryer cylinder, or Yankee cylinder, according to claim 7, wherein said step of making a plurality of grooves at said internal surface provides to make an end group of grooves at said first, or second, terminal portion of said first, or second, cylindrical portion of shell, said end group of grooves comprising at least a first and at least a second circumferential groove having a width l that increases and a depth d that decreases going towards said enlarged terminal portion of said cylindrical portion of shell, in such a way to uniformly distribute, in operating conditions, the loads along the final shell.

11. Method for producing a Yankee dryer cylinder, or Yankee cylinder, according to claim 7, wherein at the end of said forging step, said enlarged terminal portion has a tapered internal surface arranged to delimit a circumferential groove having a width greater than the width of the adjacent end groove and a depth that is less than its depth.

* * * * *